US006837393B1

(12) United States Patent
Kuo

(10) Patent No.: US 6,837,393 B1
(45) Date of Patent: Jan. 4, 2005

(54) GARBAGE CAN WITH A PAIR OF TOP SHUTTERS OPENABLE WITH A PEDAL

(75) Inventor: Chen-Hung Kuo, Tainan (TW)

(73) Assignee: Sincere & Well Being Industrial Co., Ltd., Tainan Hsien (TW)

( * ) Notice: Subject to any disclaimer, the term of this patent is extended or adjusted under 35 U.S.C. 154(b) by 12 days.

(21) Appl. No.: 10/623,632

(22) Filed: Jul. 22, 2003

(51) Int. Cl.[7] ..... B65D 43/26

(52) U.S. Cl. ..... 220/263; 220/908; 220/825; 220/827; 220/264

(58) Field of Search ..... 220/262–264, 220/908, 252, 825–827, 830; 217/57, 60 R, 60 B, 62; 49/273, 274

(56) References Cited

U.S. PATENT DOCUMENTS 2,419,163 A * 4/1947 Pope, Sr. ..... 220/23.87
2,470,271 A * 5/1949 Steinbacher ..... 248/97
5,170,904 A * 12/1992 Neuhaus ..... 220/262
5,292,023 A * 3/1994 Yen ..... 220/264
5,881,896 A * 3/1999 Presnell et al. ..... 220/252
6,626,317 B2 * 9/2003 Pfiefer et al. ..... 220/263

* cited by examiner

*Primary Examiner*—Robin A. Hylton
(74) *Attorney, Agent, or Firm*—Rosenberg, Klein & Lee

(57) ABSTRACT

A garbage can has two shutters, which can be made to pivot between a closed position by means of a tension spring and an opened position by means of depressing a pedal; the pedal is connected to a connecting rod up and down movable together with an actuating plate for the shutters; the connecting rod is further connected to a buffer mechanism consisting of a fixed rod part, and main body, which is movable relative to the rod part together with the connecting rod, so that the main body will move up relative to the rod part at such a speed as to counteract the tension spring, and slow down the movement of the shutters from the opened position to the closed position after the pedal is released from the depressed position, preventing the shutters from hitting the containing body too hard.

5 Claims, 7 Drawing Sheets

GARBAGE CAN WITH A PAIR OF TOP SHUTTERS OPENABLE WITH A PEDAL

BACKGROUND OF THE INVENTION

1. Field of the Invention

The present invention relates to a garbage can with a pair of top shutters capable of being opened by means of a pedal, and more particularly one, which is equipped with a buffer mechanism for preventing the shutters from hitting the containing body too hard when the shutters are being closed.

2. Brief Description of the Prior Art

Referring to FIG. 8, a conventional garbage can includes an outer can body 10, an inner can body 20, a lid 30, and an opening mechanism for the lid 30. The inner can body 20 is disposed in, and can be removable from the outer can body 10. The lid 30 is pivoted to an upper end of the outer can body 10. The opening mechanism includes an actuating rod 301, a connecting rod 302, and a pedal 303. The actuating rod 301 is pivoted to the lid 30, and a first end of the connecting rod 302 at upper and lower ends respectively. The connecting rod 302 is laid down in a lower portion of the outer can body 10, and projects from the upper end of the body 10 at a second end opposite the first end. The connecting rod 302 is joined to the pedal 303 at the second end, and supported on a fulcrum at an intermediate portion thereof to be capable of working as a lever. Thus, the lid 30 can be opened by means of depressing the pedal 303. And, the lid 30 will shut from the open position due to gravity when the pedal 303 is released from the depressed position. The garbage can is found to have disadvantages as followings:

1. The lid will hit the can bodies relatively hard, and make loud noise when it is shutting from the opened position.
2. For the same reason as above, the garbage can is prone to crack or get damaged through use over time, and has reduced service life.
3. The users might have their fingers hurt in case they put their fingers between the lid and the can bodies when the lid is shutting.

SUMMARY OF THE INVENTION

It is an object of the present invention to provide a garbage can to overcome the above disadvantages.

The garbage can has two shutters, which can be made to pivot between a closed position by means of a tension spring and an opened position by means of depressing a pedal, which is connected to a connecting rod up and down movable together with it; a buffer mechanism is provided, which consists of a fixed piston rod, and main body movable relative to the piston rod together with the connecting rod. The main body will move up relative to the piston rod at such a speed as to counteract the tension spring, and slow down the movement of the shutters from the opened position to the closed position after the pedal is released from the depressed position, preventing the shutters from hitting the containing body too hard.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
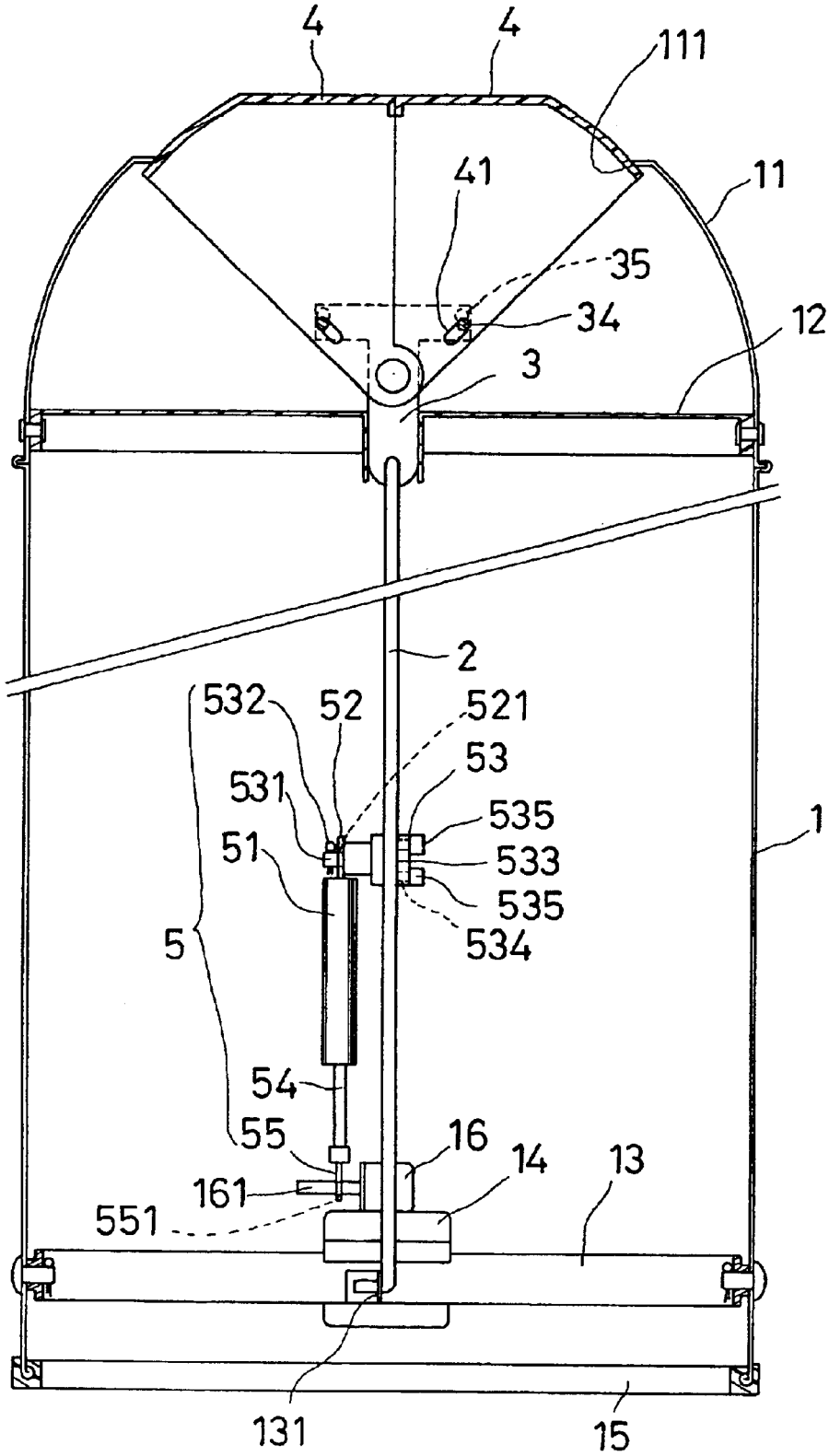
FIG. 1 is a view of the garbage can of the present invention with the shutters being in the closed position.
Figure 2:
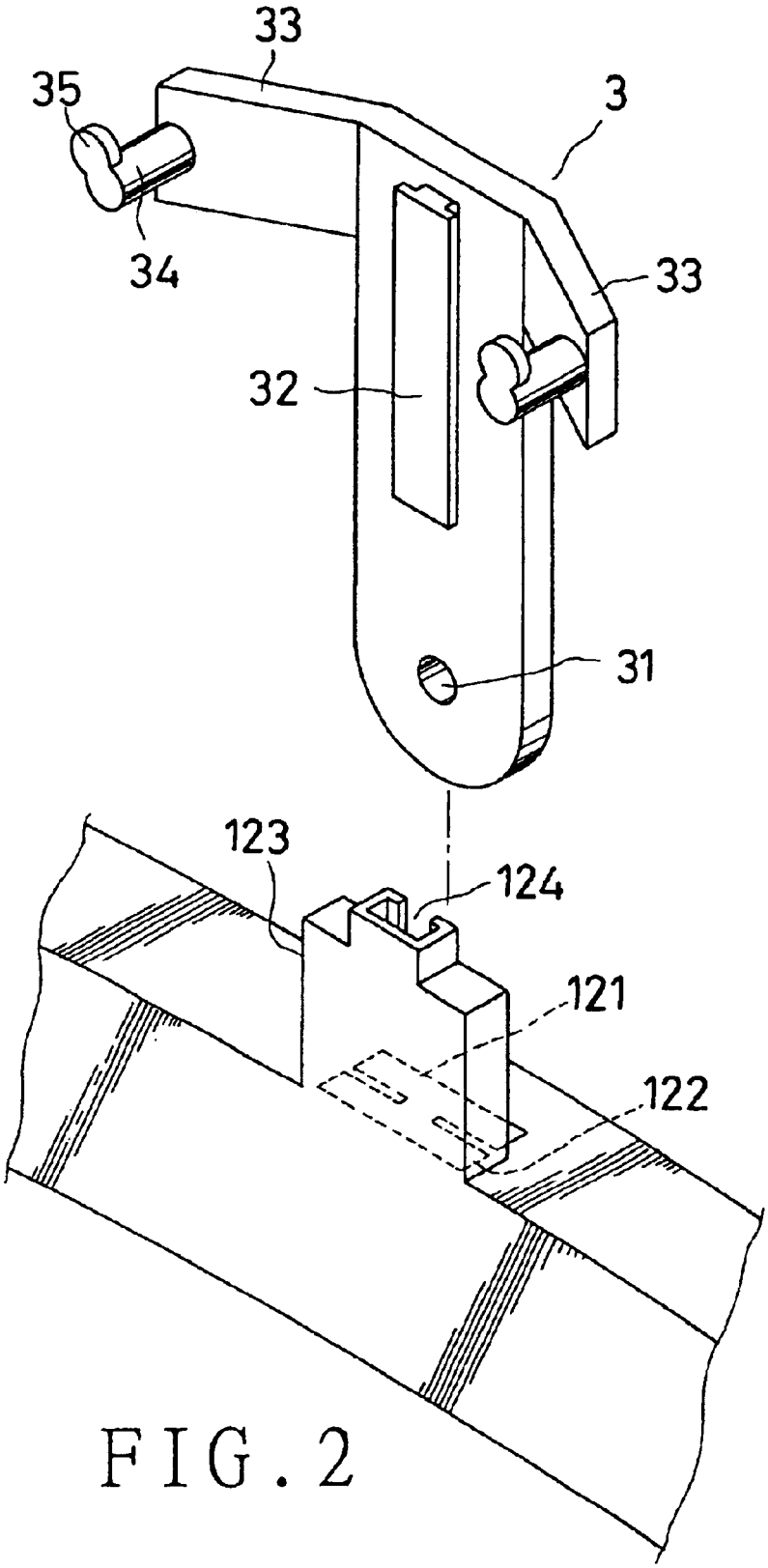
FIG. 2 is a partial exploded perspective view of the garbage can according to the present invention.
Figure 3:
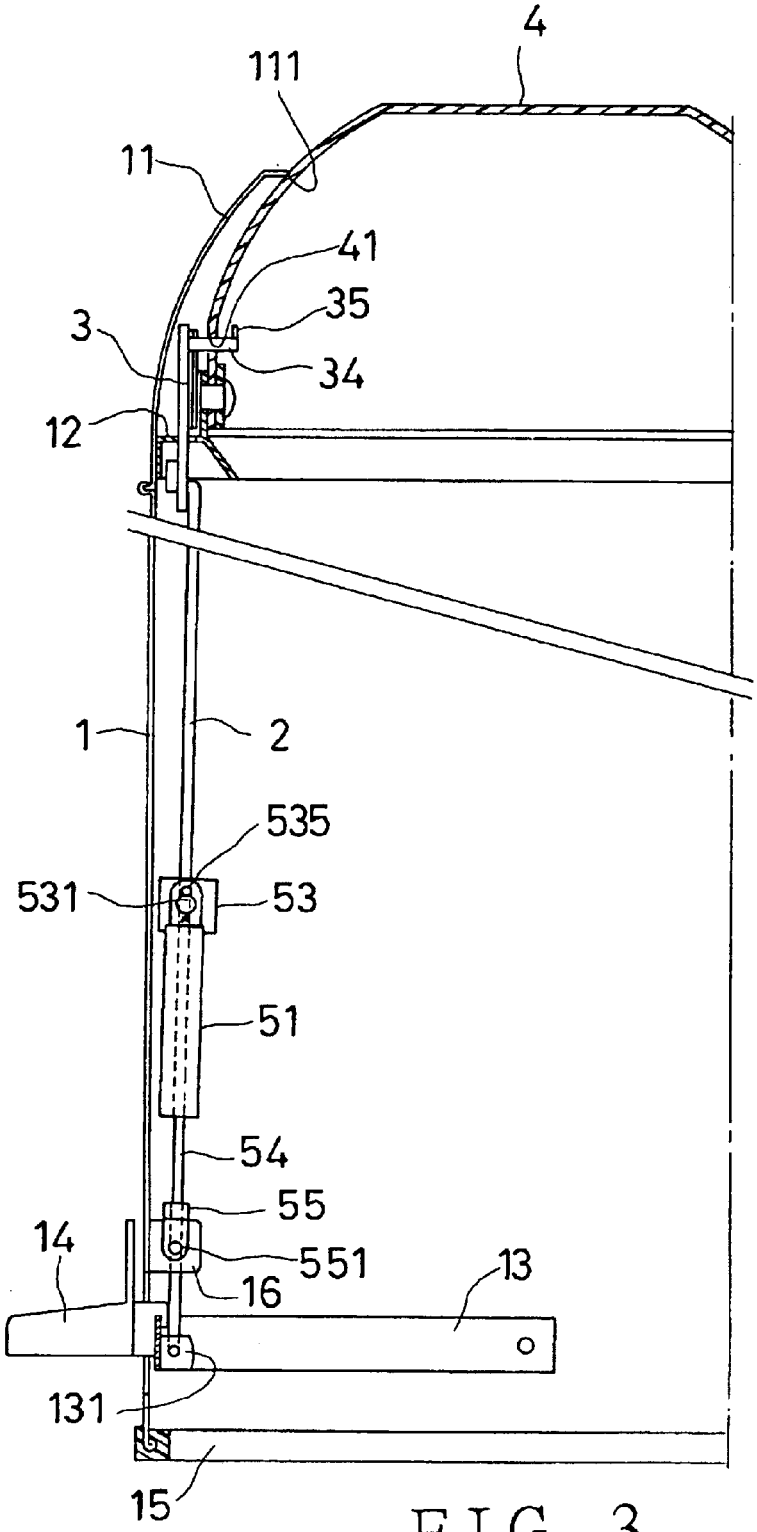
FIG. 3 is a partial view of the garbage can of the present invention with the shutters being in the closed position.
Figure 4:
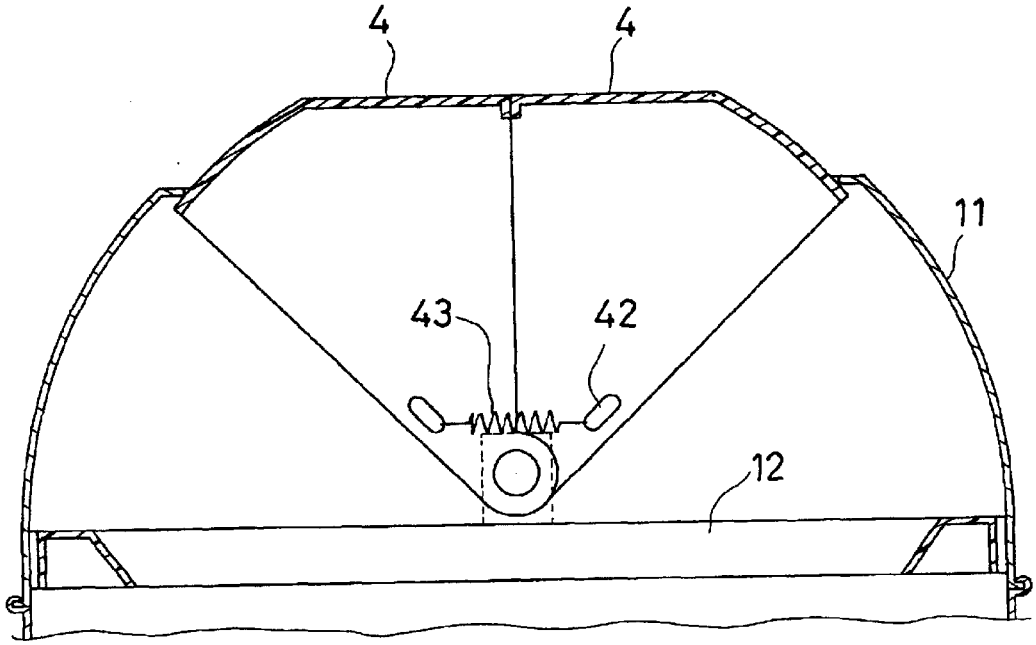
FIG. 4 is a view of the top shutters of the garbage can of the present invention, in the closed position.
Figure 7:
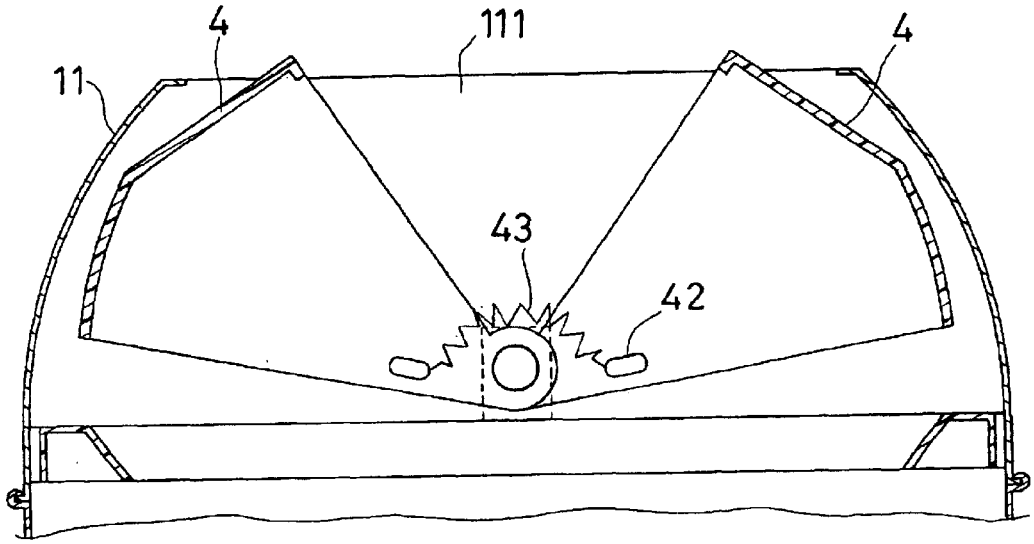
FIG. 7 is a view of the top shutters of the garbage can of the present invention, in the opened position.
Figure 5:
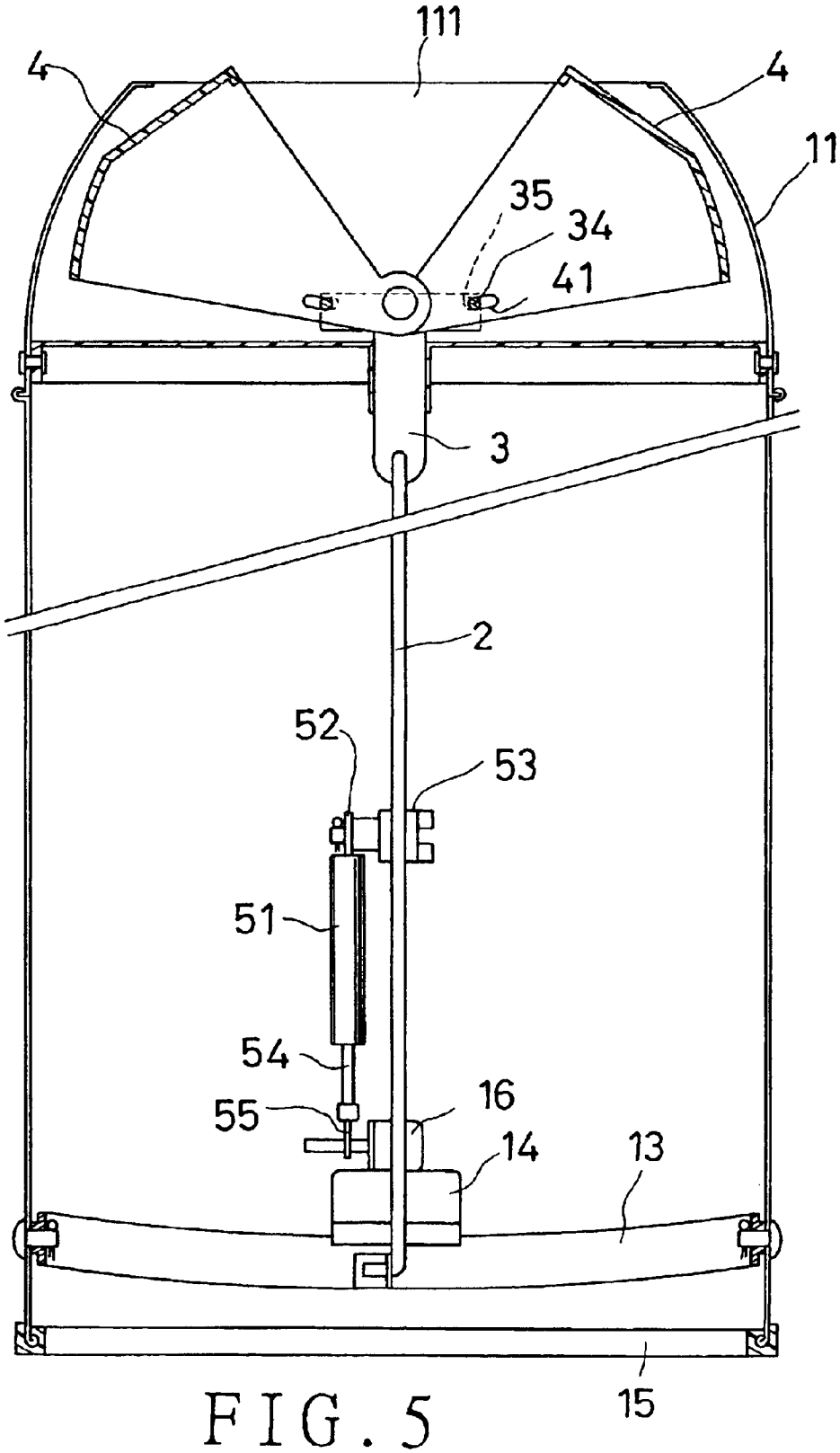
FIG. 5 is a view of the garbage can of the present invention with the shutters being in the opened position.
Figure 6:
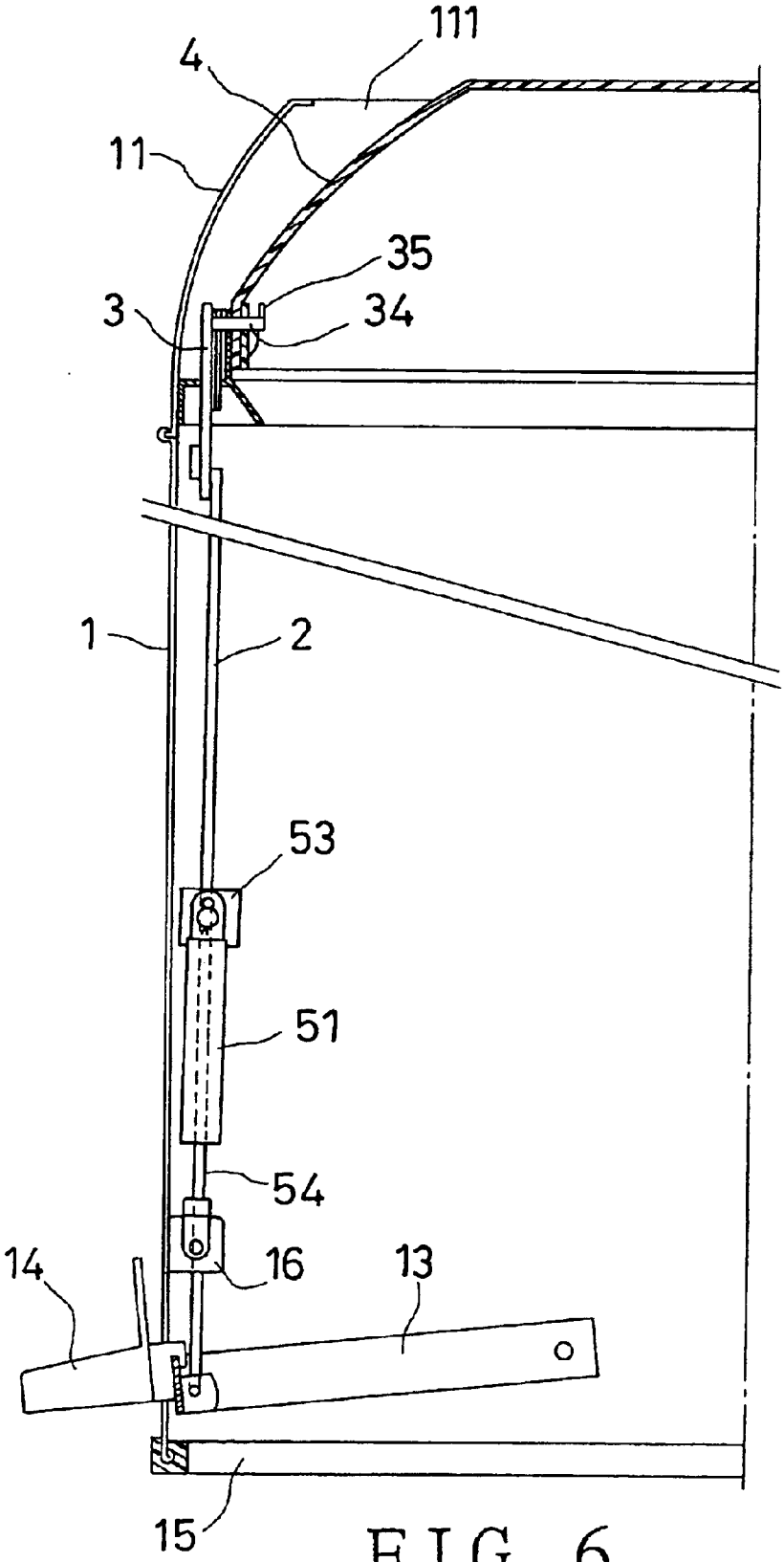
FIG. 6 is a partial view of the garbage can of the present invention with the shutters being in the opened position.
Figure 8:
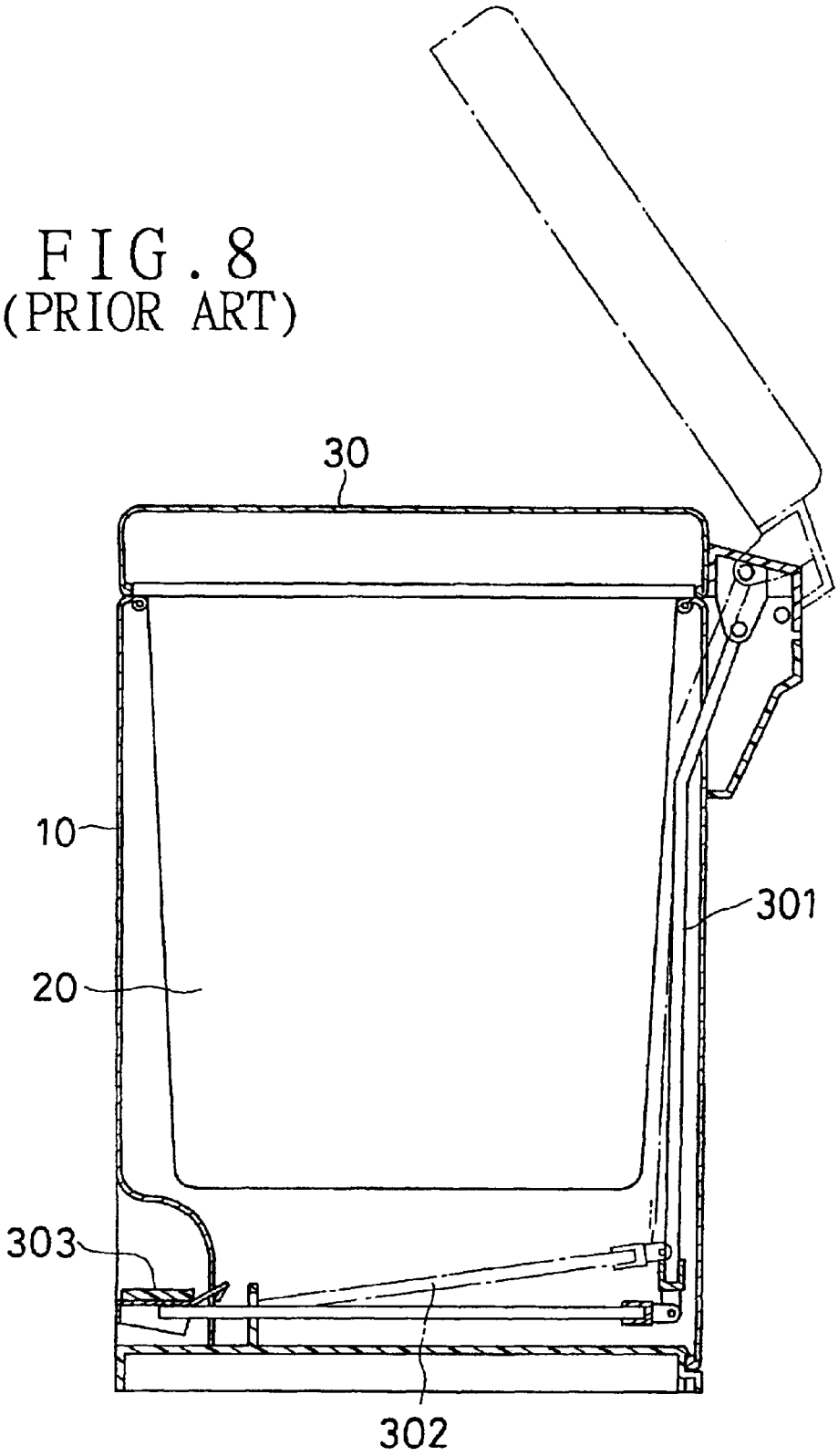
FIG. 8 (PRIOR ART)
FIG. 8 is a view of the conventional garbage can as described in the background.

Referring to FIGS. 1 to 3, a preferred embodiment of a garbage can in the present invention includes an outer containing body 1, a pair of top shutters 4, a control mechanism for the shutters 4, a pedal 14, and a buffer mechanism 5.

The outer containing body 1 has a slip-prevention pad 15 joined to the bottom thereof, an annular surrounding member 11 joined to an upper end thereof, and a ringed member 12 secured to an inner side of a lower end of the annular surrounding member 11. The annular surrounding member 11 has a lower opening (not numbered), and an upper opening 111, which is smaller than the lower opening in diameter. The ringed member 12 has front and rear slots 121, and 122 on a horizontal portion thereof, a gap communicating with both of the slots 121 and 122, and a holding portion 123 projecting upwards over the rear slot 122 from the horizontal portion thereof. The holding portion 123 has a longitudinal guiding trench 124 communicating with the rear slot 122 of the ringed member 12. Each of the top shutters 4 has an upper covering portion, and front and rear portions projecting down from the upper covering portion thereof. The shutters 4 are pivoted to the annular surrounding member 11 at lower ends of front and rear portions thereof so that they can be moved between a shut position where both shutters 4 abut each other at opposing edges thereof to cover the upper opening 111 of the annular surrounding member 11 and an opened position where the opposing edges of the shutters are apart from each other, and garbage can be thrown into the containing body 1. Each of the shutters 4 has slots 41 and 42 on the front and the rear portions thereof respectively, which slots 41, 42 are formed in such a manner as to be in a sloping position when the shutters 4 are closed. A tension spring 43 is connected to the rear slots 42, 42 of both shutters 4 at two ends thereof so that the shutters 4 are normally biased to the closed position.

The control mechanism includes an actuating plate 3, a connecting rod 2, a semicircular pivotal member 13, and a pedal 14. The actuating plate 3 has a main body (not numbered), two wings 33, 33 projecting from two sides of an upper end of the main body thereof, a connecting hole 31 on a lower end of the main body, and a guiding bar 32 on the main body. Each of the wings 33 has a rod part 34 projecting from it. Each of the rod parts 34 has a stopping protrusion 35 at a tail end. The actuating plate 3 is up and down movably passed into the front slot 121 of the circular member 12 at the main body with the guiding bar 32 being passed into the guiding trench 124; the rod parts 34 face inwardly of the outer containing body 1, and are passed through respective ones of the slots 41 of the shutters 4 with the stopping protrusions 35 preventing the shutters 4 from easily separating from the actuating plate 3.

The semicircular pivotal member 13 is arranged in a lower portion of the outer containing body 1, and pivoted to the outer containing body 1 at two ends thereof. The semicircular pivotal member 13 has a connecting ear 131 at the middle portion thereof. The connecting rod 2 is hooked onto the connecting hole 31 of the actuating plate 3, and a hole of the connecting ear 131 at upper and lower folded ends thereof respectively. The pedal 14 is connected to the middle of the pivotal member 13, and projects out from the outer containing body 1. Thus, when the pedal 14 is depressed, the actuating plate 3 will move downwards, and in turns, the rod parts 34 of the actuating plate 3 will act against the tension spring 43 to make the shutters 4 pivot to the opened position. And, when the pedal 14 is released from the depressed position, the tension spring 43 will force the top shutters 4 to pivot back to the normal closed position.

The buffer mechanism 5 includes a main body 51, and a piston rod 54, which is connected to, and movable relative to the main body 51. The main body 51 is disposed upright in the outer containing body 1, and joined to the connecting rod 2 of the control mechanism at the upper end. An outer end of the piston rod 54 is joined to a plate 16, which is fixedly joined to the containing body 1; the lower outer end of the piston rod 54 is farthest away from the main body 51 when the shutters 4 are in the closed position. Thus, when the pedal 14 is depressed to open the shutters 4, the main body 51 of the buffer mechanism 5 will move down together with the connecting rod 2, and towards the lower outer end of the piston rod 54. And, when the pedal 14 is released from the depressed position, the main body 51 will move up relative to the outer end of the piston rod 54 slowly while the tension spring 43 will force the shutters 4 to pivot to the closed position. Consequently, the shutters 4 are made to pivot to the closed position at a reduced speed due to the buffer mechanism 5. The slots 121 and 122, the guiding trenches 124, and the holding portion 123 of the circular member 12 will make the actuating plate 3 move up and down relative to the circular member 12 smoothly when the shutters 4 are moved from the closed position to the opened one, and vice versa.

Going into details, the main body 51 has a connecting projection 52 on the upper end, which has a through hole 521. A connecting block 53 is provided to connect the connecting projection 52 to the connecting rod 2; the connecting block 53 has a projection 531, a connecting trench 533, and several screw holes 534 communicating with the connecting trench 533; the projection 531 is passed through the through hole 521, and a pin 532 is fitted into a hole (not shown) of the projection 531 so that the connecting block 53 is joined to the main body 51 of the buffer mechanism 5; the connecting trench 533 is fitted over an intermediate section of the connecting rod 2, and fixing elements 535 are screwed into the screw holes 534 to secure the connecting rod 2 to the connecting block 53. And, the lower outer end of the piston rod 54 has a connecting ear 55 while the plate 16 fixed to the outer containing body 1 has a rod 161 projecting from it, which rod 161 is passed through a hole 551 of the connecting ear 55; thus, the piston rod 54 is joined to the fixed plate 16.

From the above description, it can be easily understood that the garbage can of the present invention has advantages as followings:

1. The top shutters 4 can be prevented from hitting the outer containing body 1 hard to produce loud noise by means of the buffer mechanism when they are being shut.
2. For the same reason as above, movement of the shutters 4 from the opened position to the closed position can't cause damage to the garbage can, and normal service life of the garbage can be maintained.
3. Because the shutters 4 will move from the opened position to the closed position slowly, they can't cause injury to the user's fingers.

What is claimed is:

1. A garbage can, comprising an outer containing body; the containing body having a slip-prevention pad joined to a bottom thereof; the containing body having an annular surrounding member joined to an upper end thereof; the containing body having a ringed member secured to an inner side of a lower end of the annular surrounding member; the annular surrounding member having an upper opening smaller than a lower opening thereof; the ringed member having front and rear slots, and a gap communicating with both of the slots thereof; the ringed member having a holding portion projecting upwards over the rear slot; the holding portion of the ringed member having a longitudinal guiding trench communicating with the rear slot thereof;

a pair of top shutters pivoted to an inner side of the annular surrounding member at front and rear ends thereof so as to be movable between a closed position with opposing edges thereof abutting each other and an opened position with the opposing edges being apart from each other; each shutter having slots respectively near to the front and the rear ends thereof; the slots being formed in such a manner as to be in a sloping position when the shutters are is a closed position; a tension spring being connected to the rear slots of both shutters for biasing the shutters to the closed position;

a control mechanism for opening the shutters with; the control mechanism having:

(1) an actuating plate having a main body, and two wings projecting from two sides of an upper end of the main body thereof; the actuating plate having a guiding bar on the main body thereof; each of the wings having a rod part projecting from it; each of the rod parts having a stopping protrusion at a tail end thereof; the main body being up and down movably passed into the front slot of the ringed member with the guiding bar being passed into the guiding trench; the rod parts facing inwardly of the outer containing body, and passed through respective ones of the slots of the shutters;

(2) a connecting rod connected to the actuating plate at an upper end;

(3) a semicircular pivotal member arranged in a lower portion of the outer containing body; the semicircular pivotal member being pivoted to the outer containing body at two ends thereof; the semicircular pivotal member being connected to a lower end of the connecting rod at a middle portion thereof;

(4) a pedal connected to the semicircular pivotal member, and projecting out from the outer containing body for making the connecting rod and the actuating plate move down to pivot the shutters to the opened position when being depressed; and a buffer mechanism having a main body, and a piston rod movable relative to the main body; the piston rod projecting down from a lower end of the main body, and being fixedly connected to the outer containing body at the lower end; the main body being fixedly joined to the connecting rod of the control mechanism at an upper end for up and down displacement together with the connecting rod relative to the piston rod; the lower end of the piston rod being farthest away from the main body of the buffer mechanism when the shutters are in the closed position; the main body moving up relative to the piston rod at such a speed as to counteract the tension spring, and slow down the movement of the shutters from the opened position to the closed position after the pedal is released from the depressed position.

2. The garbage can as claimed in claim 1, wherein the buffer mechanism is a hydraulic cylinder.

3. The garbage can as claimed in claim 1, wherein the buffer mechanism is a gas cylinder.

4. The garbage can as claimed in claim 1, wherein the main body of the buffer mechanism has a connecting projection at the upper end, which has a through hole, and a connecting block is provided to connect the connecting projection to the connecting rod; the connecting block having a projection passed into the connecting projection of the main body; the connecting block having a connecting trench fitted over the connecting rod; the connecting block having a plurality of screw holes communicating with the connecting trench; a pin being fitted into the through hole of the connecting projection; fixing elements being screwed into the screw holes to secure the connecting rod to the connecting block.

5. The garbage can as claimed in claim 1, wherein the lower outer end of the piston rod has a bored connecting ear while the outer containing body has a fixed plate projecting from an inner side, which fixed plate has a rod projecting from it, and passed through a hole of the connecting ear.

* * * * *